US005417089A

United States Patent [19]

Honeycutt

[11] Patent Number: 5,417,089

[45] Date of Patent: May 23, 1995

[54] END CLOSURE APPARATUS FOR A TUBULAR-KNITTED ARTICLE

[76] Inventor: Larry W. Honeycutt, P.O. Box 86, Concord, N.C. 28026

[21] Appl. No.: 146,871

[22] Filed: Nov. 2, 1993

[51] Int. Cl.[6] ..... D04B 35/00

[52] U.S. Cl. ..... 66/147

[58] Field of Search ..... 66/147, 148, 149 R, 66/150, 151, 152, 153; 83/15, 22, 936; 156/82, 251, 497, 515; 264/145, 148, 150, 152, 157, 159, 160, 163

[56] References Cited

U.S. PATENT DOCUMENTS

| | | | |
|---|---|---|---|
| 3,017,314 | 4/1962 | Keberus et al. | 156/198 |
| 3,234,072 | 2/1966 | Dreeben | 156/497 |
| 3,340,707 | 8/1967 | Currier | 66/26 |
| 3,550,402 | 1/1970 | Colton | 66/147 |
| 4,069,090 | 4/1978 | Boyer | 156/498 |
| 4,102,727 | 7/1978 | Bell | 156/251 |
| 4,151,651 | 5/1979 | Coggins et al. | 66/147 |
| 4,463,542 | 8/1984 | Greenawalt | 156/251 |

OTHER PUBLICATIONS

Leaflet 20G for Leister-dated Sep. 1990.

*Primary Examiner*—Clifford D. Crowder
*Assistant Examiner*—Larry D. Worrell, Jr.
*Attorney, Agent, or Firm*—Rhodes, Coats & Bennett

[57] ABSTRACT

A method and apparatus for use in a circular knitting machine to form an end closure in a knitted tube made of thermoplastic yarn. The apparatus includes a tube constrictor mounted on the knitting machine for constricting the knitted tube formed by the knitting machine to form a generally solid, compact mass. The tube constrictor includes a plurality of constricting elements which define an aperture through which the knitted tube extends. The constricting elements are moveable between an open position and a closed position in which the knitted tube is gathered into a generally solid compact mass. A hot-air nozzle connected to a hot-air source is engageable with the air passage in the tube constrictor for directing a stream of hot air through said passage to sever and fuse said compact mass and to form a heat-sealed closure at one end of the tube segment severed from the knitted tube.

17 Claims, 4 Drawing Sheets

END CLOSURE APPARATUS FOR A TUBULAR-KNITTED ARTICLE

BACKGROUND OF THE INVENTION

The present invention relates generally to the manufacture of tubular-knitted articles, and more particularly to a method and apparatus for forming a closed end in a tubular-knitted article.

In the production of circular-knit hosiery, one end of a knitted-tubular fabric is closed to form the toe. Traditional methods for closing the end of a tubular fabric include difficult and expensive looming operations or seaming operations. These operations are usually performed separately from the knitting operations, are relatively costly, and result in lower productivity.

Another method which has been tried in the past is to close the end of the tubular fabric while it is on a circular-knitting machine. For example, in U.S. Pat. No. 4,069,090, describes a method for forming an end closure in a tubular-knitted article in which a portion of the knitted tube is gathered into a generally solid, compact mass and then severed with a heated tool. The heated tool also fuses the yarns at the end of the severed segment to form a closed end. Additional examples of prior art machines which attempt to close the end of the tubular fabric while it is on a circular-knitting machine are shown in the patents to Currier, U.S. Pat. No. 3,340,707; and Colton, U.S. Pat. No. 3,550,402. None of these methods have been reliable in forming a closed end in the tubular-knitted article.

SUMMARY OF THE INVENTION

The present invention provides a method and apparatus for forming an end closure in a tubular-knitted article made of thermoplastic yarns. The end-closure apparatus includes a tube constrictor which is mounted on a knitting machine between the knitting cylinder and the fabric take-down. The tube constrictor includes a plurality of constricting elements which collectively define a variable size aperture through which the knitted tube extends. The constricting elements are radially moveable between an open position and a closed position to vary the size of the aperture. When the constricting elements are in the closed position, the knitted tube is constricted to form a generally solid, compact mass along a portion thereof.

At least one of the constricting elements includes an air passage which communicates with the aperture defined by the constricting elements. A hot-air nozzle connected to a hot-air source is engageable with the air passage in the constricting element for directing a stream of hot air through said passage. The high velocity stream of air melts the yarns of the knitted tube and severs a portion of the knitted tube from the remainder to form a tube segment. The constricting elements continue to hold the yarns on the knitted tube and on the tube segment. The heated air fuses the yarns on both pieces to form end closures. After forming the end closures, the constricting elements are moved back to an open position.

The end closure apparatus of the present invention provides an effective and reliable means for severing and sealing the ends of a tubular article to form an end closure. The present invention allows the end closure to be formed while the tubular fabric is still on the circular knitting machine thereby eliminating an extra production step in the manufacture of knitted hosiery and other tubular knitted articles. Thus, the present invention increases productivity and reduces cost resulting in significant savings for the manufacturer.

DESCRIPTION OF THE PREFERRED EMBODIMENT

Figure 1:
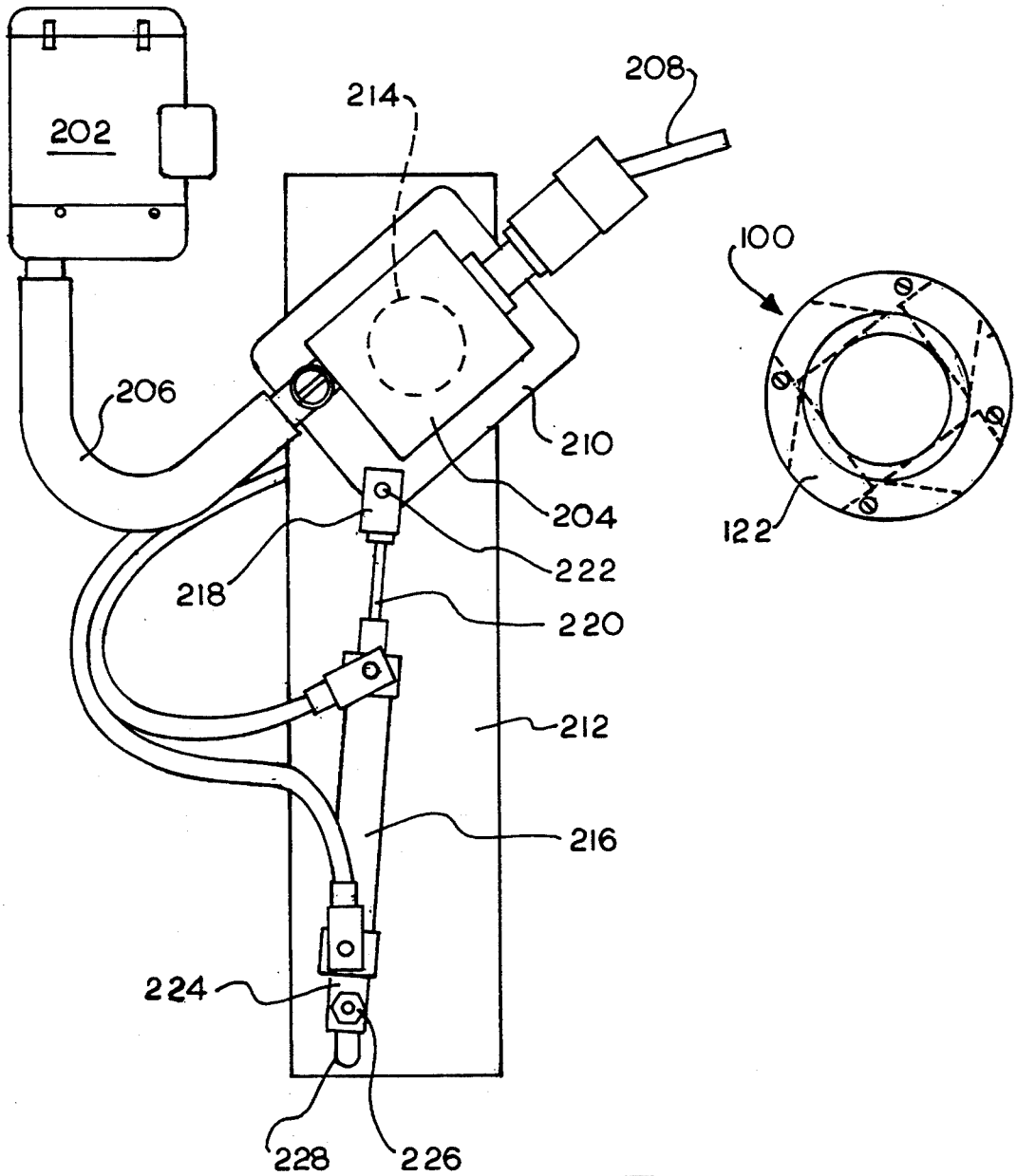
FIG. 1 is a plan view of the end closure apparatus showing the hot-air cutter assembly in a disengaged position and the tube constrictor in an open position.
Figure 2:
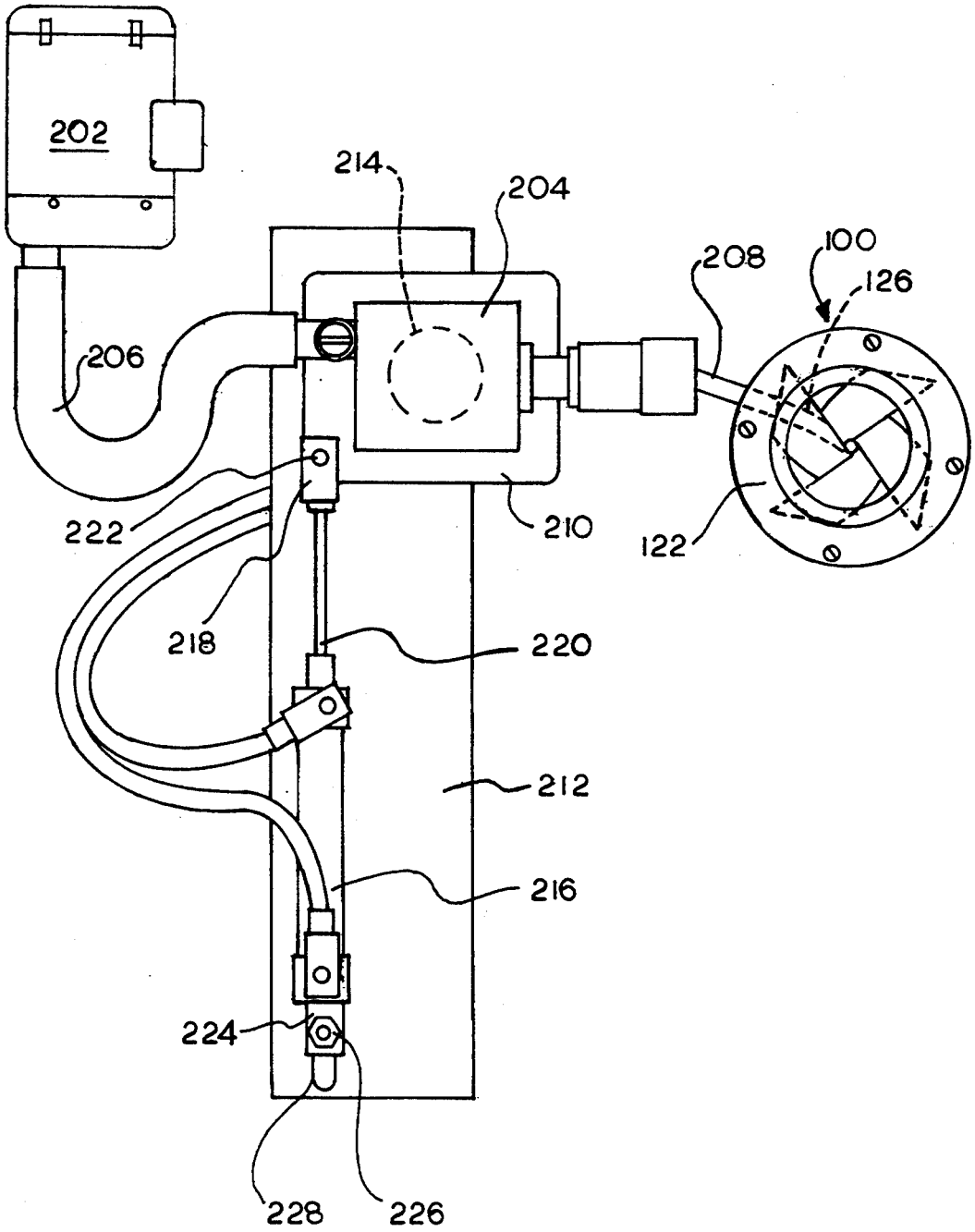
FIG. 2 is a plan view of the end closure apparatus showing the hot-air cutter assembly in an engaged position and the tube constrictor in a closed position.

Referring now to the drawings, and particularly to FIGS. 1 and 2, the end closure apparatus of the present invention is shown therein and indicated generally by the numeral 10. The end-closure apparatus 10 is designed for use in connection with a circular knitting machine which produces a tubular-knitted article. The end closure apparatus functions to sever the knitted tube into discrete segments and to close at least one end of each tubular segment. The end closure apparatus includes a tube constrictor 100 for constricting a portion of the knitted tube into a generally compact, solid mass, and a hot air cutter assembly 200 for severing the knitted tube and for fusing the yarns to close the end of the tube.

The construction of the tube constrictor 100 is well-known in the art. For example, a suitable tube constrictor is shown in U.S. Pat. No. 4,069,090 to Boyer which is incorporated herein in its entirety by reference. To briefly summarize, the tube constrictor 100 comprises an annular main body 102 having a central opening 104. The main body 102 is formed with four guide channels 106 arranged orthogonally around the central opening 104. A guide slot 108 (See FIG. 3) extends from the bottom of each guide channel 106. The guide slots 108 extend through the main body 102 to allow passage there through of a guide pin 114 as will be hereinafter described.

A plurality of constricting elements 110 are slidably mounted on the main body 102. The constricting elements 110 include a guide rail 112 which is received in the guide channel 106. The guide rail 112 constrains the movement of the constricting elements 110 linearly along a corresponding guide channel 106 in the main body 102. A pin 114 depends downwardly from the bottom edge of each guide rail 112 and extends through a corresponding guide slot 108. The pin 114 projects downwardly from the guide slot 108 so that it can be engaged by an actuating member 140 as will be hereinafter described.

Each of the constricting elements 110 includes a pair of guide faces 116 and 118. The guide faces 116, 118 are disposed perpendicular to one another and at a 45° angle with respect to the guide rail 112. The constricting elements 110 are arranged in the main body 112 such that the guide faces 116, 118 of each constricting element 110 contract the guide faces 116, 118 of adjacent constricting elements 110. In particular, the guide face 116 of each constricting element 110 contacts the guide face 118 of a first adjacent constricting element 110, and the guide face 118 engages the guide face 116 of a second adjacent constricting element 110. The constricting elements 110 collectively define a variable aperture 120 which varies in size as the constricting elements 110 are moved.

The constricting elements 110 are retained in place by a top plate 122 which is mounted on top of the main body 102. The top plate 128 comprises a ring-like member that includes a central opening 130. Spacers 132 are disposed between the main body 102 and the top plate 122 to provide room for the constricting elements 110. The spacers 132 thread into opening in the main body 102. The top plate 128 is secured to the spacers 132 by screws 134.

Figure 3:
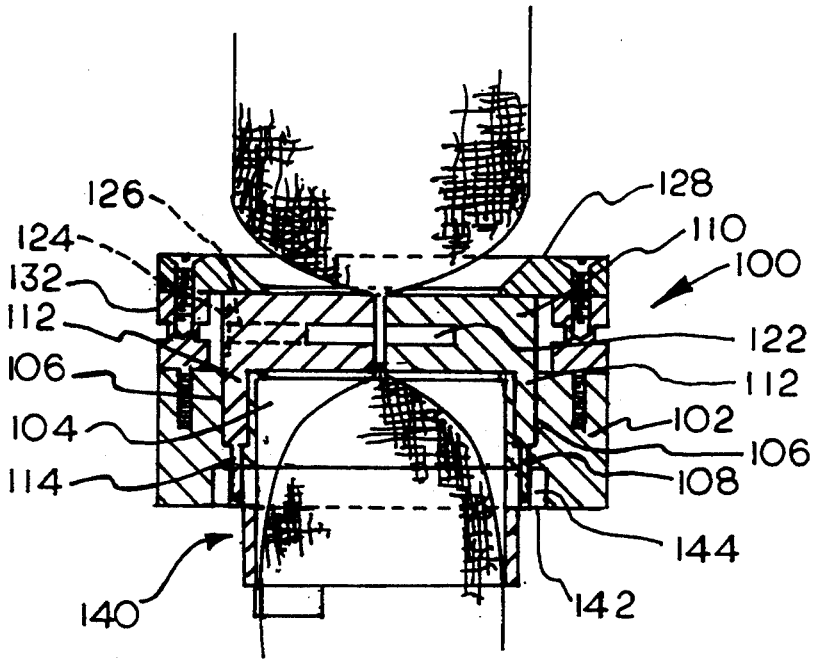
FIG. 3 is a section view of the tube constrictor.
Figure 4:
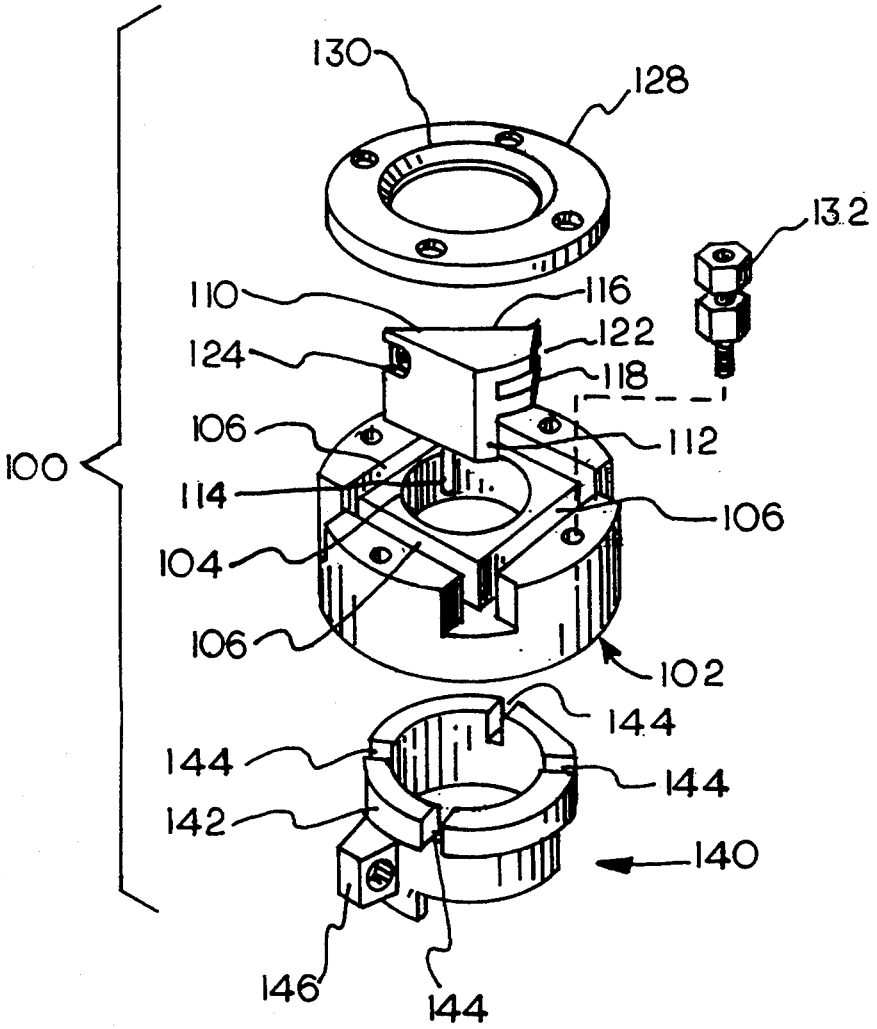
FIG. 4 is an exploded perspective view of the tube constrictor.

An actuator 140 simultaneously moves each of the constricting elements 110 to open and close the aperture 120. The actuator 140 comprises a ring-like body 142 having four slots 144 disposed at 90° with respect to one another. A protruding member 146 extends radially from the actuator 140. The protruding member 146 can be engaged by mechanical means (not shown) to rotate the actuator 140. The actuator 140 mates with the main body 102, as seen in FIG. 3, such that the slots 144 engage the pins 114 of the constricting elements 110. When the actuator 128 is rotated, the walls of the slots 144 apply a lateral force to the pins 114 of the constricting elements 110 to move the constricting elements 110. The movement of the constricting elements 110 is constrained by the guide channels 106 and guide rail 112. Rotation of the actuator 140 in a first direction causes the constricting elements 110 to move radially outwardly opening the aperture 120. (See FIG. 1) Conversely, rotation of the actuator 140 in a second direction causes the constricting elements 110 to move radially inward closing the aperture 120. (See FIG. 2).

Each of the constricting elements 110 is formed with a horizontally-extending slot 122. The slot 122 bisects the guide faces 116, 118. In the past, the slot 122 was used to accommodate a heated tool, but is used in the present invention in a totally different manner. In the present invention, the slots 122 in the constricting elements 110 collectively define a manifold surrounding the aperture 120. An inlet port 124 is formed in one of the constricting elements 110 and is communicatively connected to the slot 122 by an air passage 126. The inlet port 124 is adapted to mate with the hot-air cutter assembly 200 (described below) to allow ejection of a high velocity stream of air into the manifold defined by the slots 122. This high velocity stream of air is used to sever the knitted tube and to fuse the yarns of the tube segment to form an end enclosure.

Referring now to FIGS. 1 and 2 is shown. The hot-air cutter 200 includes a blower 202 for generating a high-velocity air stream, and a heater 204 for heating the air stream. The heater 204 is connected to the blower by an air hose 206. The heater 204 includes a nozzle 208 through which the heated air exits the heater 204. The nozzle 208 is adapted to mate with the inlet port 124 in the constricting element 110.

The heater 204 is fixedly secured to a support plate 210 which is pivotally mounted to a frame member 212 by a swivel assembly 214. The support plate 212 is rotated by a cylinder 216. A yoke 218 is mounted on the cylinder rod 220 and is connected to the support plate 210 by a pivot pin 222. The opposite end of the cylinder 216 is connected to a bracket 224. A bolt 226 extends through the bracket 224 and passes through a slot 228 in the frame member 212. The slot 228 allows adjustment of the cylinder 216. By sliding the cylinder 216 along the slot 228 in the frame member 212, the throw of the cylinder 216 can be adjusted which in turn effects how much the support plate 210 is rotated.

The cutter assembly 200 is rotatable between a disengaged position shown in FIG. 1 and an engaged position shown in FIG. 2. The cutter assembly moves to the disengaged position when the cylinder 216 is retracted and to the engaged position when the cylinder 216 is extended. In the disengaged position, the nozzle 218 is moved out of contact with the tube constrictor 100. In the engaged position, the nozzle 208 mates with the inlet port 124 of one of the constricting elements 110. Hot air is directed through the inlet port 124 and into the manifold defined by the slots 122. The high velocity air stream melts the yarns of the knitted tube thereby severing the tube to form a tube segment. Additionally, the heat from the air stream fuses the yarns at the end of the knitted tube and the end of the tube segment to form an end closure on each piece. After the knitted tube is severed, the yarns of the tube are held in place by the constricting elements 110 until the heat fuses the yarns. An end closure is thus formed simultaneously on both the knitted tube and on the tube segment severed from the knitted tube.

The tube constrictor is mounted on the knitting machine between the knitting cylinder and the fabric takedown. The knitted tube is fed through the central opening 104 of the main body 102. The constricting elements 110 normally remain in an open position as shown in FIG. 1 while the knitted tube is formed. Once the desired length of tube is formed, the actuator 140 is rotated to move the constricting elements 110 to the position shown in FIGS. 2 and 3. As the constricting elements 110 move radially inward, a portion of the knitted tube is constricted to form a generally compact, solid mass. (See FIG. 2 and 3)

Once the knitted tube is gathered, cylinder 216 is actuated to rotate the hot air cutter assembly 200 until the nozzle 208 engages the inlet port 124 in one of the constricting elements 110. Heat air is thus directed into the manifold defined by the slots 122 in the constricting elements 110. The heated air melts the thermoplastic yarns of the knitted tube to sever the knitted tube. At the same time, the yarns on either side of the severance are fused together by the heated air. Thus, an end closure is formed both on the severed tube segment and on the knitted tube.

The end closure apparatus of the present invention provides an effective and reliable method for severing and filling the ends of a tubular article to form an end closure. The apparatus of the present invention mounts below the cylinder of a circular knitting machine so that the end closure is formed while the knitted tube is being manufactured. This process eliminates the need for a separate looming or seaming operation thereby reducing cost and increasing productivity.

The present invention may, of course, be carried out in other specific ways than those herein set forth without departing from the spirit and essential characteristics of the invention. The present embodiments are, therefore, to be considered in all respects as illustrative and not restrictive and all charges coming within the meaning and equivalency range of the appended claims are intended to be embraced therein.

What is claimed is:

1. An apparatus for a circular-knitting machine to form an end closure in a knitted tube made of a thermoplastic yarn comprising:

(a) a tube constrictor mounted on said knitting machine for constricting the knitted tube to form a generally solid, compact mass, and having a plurality of constricting elements which define an aperture through which the knitted tube extends said constricting elements being movable between an open position and a closed position;

(b) an air passage formed in at least one of the constricting elements and communicating with said aperture; and (c) a hot-air nozzle connected to a hot air source engageable with the air passage in the tube constrictor for directing a stream of hot air through said passage to sever a portion of the knitted tube and to fuse the yarns of the tube and to form a heat-sealed closure at one end of said tube.

2. The end closure apparatus of claim 1 further including moveable mounting means for mounting the hot-air nozzle so as to be moveable between a disengaged position with respect to the tube constrictor and an engaged position.

3. The end closure apparatus of claim 2 wherein the mounting means comprises a support plate movably mounted to a frame, and an actuator operatively connected to the support plate for moving the support plate between the disengaged in engaged positions.

4. The end closure apparatus of claim 3 wherein the support plate is rotatably mounted to the frame.

5. The end closure apparatus of claim 3 wherein the actuator is a pneumatic cylinder connected at one end to a frame and at the opposite end to the support plate.

6. The end closure apparatus of claim 5 wherein the yarns on the knitted tube are fused simultaneously with the yarns on one end of the severed tube.

7. An apparatus for a circular knitting machine to form an end closure in a knitted tube made of a thermoplastic yarn comprising:

(a) a tube constrictor mounted on said knitting machine for constricting a portion of the knitted tube into a compact, solid mass, said tube constrictor including:

(1) an annular main body surrounding the knitted tube;

(2) a plurality of constricting elements movably mounted on the main body for movement between an open position and a closed position in which the knitted tube is gathered into a compact mass wherein said constricting elements collectively define an aperture through which the knitted tube extends;

(3) an actuator for moving the constricting elements between the position and the closed position wherein the knitted tube is gathered into a compact mass when the constricting elements are moved to the closed position;

(b) an air passage having an inlet port formed in at least one of the constricting elements; and (c) an air nozzle engageable with the inlet port of the air passage for directing a stream of hot air through said passage to sever a portion of the knitted tube and to fuse the yarns at one end of the tube to form a heat-sealed closure.

8. The end closure apparatus of claim 7 further including moveable mounting means for mounting the hot-air nozzle so as to be moveable between a disengaged position with respect to the tube constrictor and an engaged position.

9. The end closure apparatus of claim 8 wherein the mounting means comprises a support plate movably mounted to a frame, and an actuator operatively connected to the support plate for moving the support plate to be disengaged in engaged positions.

10. The end closure apparatus of claim 9 wherein the support plate is rotatably mounted to the frame.

11. The end closure apparatus of claim 8 wherein the actuator is a pneumatic cylinder connected at one end to the frame and at the opposite end to the support plate.

12. The end closure apparatus of claim 11 wherein the yarns on the knitted tube are fused simultaneously with the yarns on one end of the severed tube.

13. A method for forming an end closure in a knitted tube made of thermoplastic yarn comprising:

(a) advancing the knitted tube;

(b) gathering a portion of the knitted tube into a generally solid, compact mass;

(c) severing said portion of the knitted tube to form a tube segment by directing a stream of heated air at the gathered portion of the knitted tube; and (d) fusing the yarn at one end of the tube segment with said heated air to form a heat-sealed closure.

14. The method of claim 13 wherein the step of gathering the knitted tube including constricting the tube at two spaced apart points along said tube.

15. The method of claim 14 wherein the step of severing the knitted tube includes dissecting said heated air at said gathered portion between said spaced apart points.

16. The method of claim 13 further including the step of fusing the yarns at the end of the knitted tube after the tube segment is severed therefrom.

17. The method of claim 16 wherein the yarns at the end of the knitted tube are fused simultaneously with the yarns at the end of the tube segment.

* * * * *